US007633458B2

(12) United States Patent
Uno et al.

(10) Patent No.: US 7,633,458 B2
(45) Date of Patent: Dec. 15, 2009

(54) ANTENNA ASSEMBLY AND MULTIBEAM ANTENNA ASSEMBLY

(75) Inventors: Hiroyuki Uno, Ishikawa (JP); Yutaka Saito, Ishikawa (JP); Genichiro Ohta, Kanagawa (JP); Yoshio Koyanagi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 301 days.

(21) Appl. No.: 11/574,816

(22) PCT Filed: Jul. 21, 2005

(86) PCT No.: PCT/JP2005/013380

§ 371 (c)(1),
(2), (4) Date: Mar. 7, 2007

(87) PCT Pub. No.: WO2006/030583

PCT Pub. Date: Mar. 23, 2006

(65) Prior Publication Data

US 2007/0216594 A1 Sep. 20, 2007

(30) Foreign Application Priority Data

Sep. 14, 2004 (JP) ..... 2004-266604

(51) Int. Cl.
*H01Q 3/24* (2006.01)
*H01Q 13/10* (2006.01)

(52) U.S. Cl. ..... 343/876; 343/746; 343/767; 343/768; 343/770

(58) Field of Classification Search ..... 343/746, 343/767, 768, 770, 876, 700 MS, 793, 810, 343/817, 818

See application file for complete search history.

(56) References Cited

U.S. PATENT DOCUMENTS 6,320,544 B1 * 11/2001 Korisch et al. ..... 343/700 MS (Continued)

FOREIGN PATENT DOCUMENTS

JP 55-46365 3/1980

(Continued)

OTHER PUBLICATIONS

Hiroyuki Uno et al., "Slot Soshi o Mochiita Chilled Beam Kirikaeshiki Sector Antenna", 2004 Nen The Institute of Electronics, Information and Communication Engineers Sogo Taikai, Tsushin 1-B-1-201, Mar. 8, 2004 (Mar. 8, 2004).

(Continued)

*Primary Examiner*—Douglas W Owens
*Assistant Examiner*—Jennifer F Hu
(74) *Attorney, Agent, or Firm*—Pearne & Gordon LLP

(57) ABSTRACT

Provided is an antenna which has a small-sized planar constitution as can be easily mounted on a small-sized radio device and which can form a principal beam having a vertical polarization in directions of low and high elevation angles.

On the surface of a substrate 11, slot elements 13A and 13B having a length of about one half wavelength are arranged in parallel at a predetermined distance d1, and a reflecting plate 14 is arranged at a predetermined distance h from the mounting face of the slot elements 13A and 13B. On the back of the substrate 11, parasitic elements 15A to 15D are made of a copper foil pattern and are arrayed to intersect the slot elements 13A and 13B at right angles. A switching element 16A is connected with the parasitic elements 15A and 15B, and a switching element 16B is connected with the parasitic elements 15C and 15D.

10 Claims, 12 Drawing Sheets

U.S. PATENT DOCUMENTS 6,407,719 B1 * 6/2002 Ohira et al. ..... 343/893

FOREIGN PATENT DOCUMENTS

| | | |
|---|---|---|
| JP | 2002-84130 | 3/2002 |
| JP | 2003-142919 | 5/2003 |
| JP | 2005-72915 | 3/2005 |
| JP | 2005-210521 | 8/2005 |

OTHER PUBLICATIONS

Hiroyuki Uno et al., "Beam Kirikae Kairo o Jisso shita Chilled Beam Slot Antenna", 2004 Nen IEICE Communications Society Conference, B-1-141, Sep. 8, 2004 (Sep. 8, 2004).

* cited by examiner

ANTENNA ASSEMBLY AND MULTIBEAM ANTENNA ASSEMBLY

TECHNICAL FIELD

The present invention relates to an antenna device to be used in a fixed radio device, a terminal radio device or the like of a radio LAN system, and a multi-beam antenna device.

BACKGROUND ART

A high-speed radio communication such as the radio LAN system is troubled by a problem that the transmission quality is degraded by the multipath fading or the shadowing, and this problem is serious indoors. A sector antenna has been investigated as one means for avoiding such degradation of transmission qualities. In this sector antenna, a plurality of antenna elements having principal beams directed in different directions are arranged and selectively switched according to the electric wave transmission environment.

Generally speaking, the antenna for a stationary station to be mounted in the ceiling or a terminal radio device a note personal computer used on a desk is required to have a planar constitution from the viewpoints of production or mobility. In the case of considering the indoor communication environments, on the other hand, the directivities of those antennas are desired such that the principal beam has an angle of elevation inclined (or tilted) from the vertical direction to the horizontal direction with respect to the antenna face. Considering the disposed position of the communication destination, moreover, it is desired that the tilting angle can be controlled.

As the sector antenna for realizing those radiation characteristics of tilting in the horizontal direction, there has been proposed a plane multi-sector antenna, which uses the "slot Yagi-Uda array", as described in Non-Patent Document 1.

This multi-sector antenna is described with reference to FIG. 11. This multi-sector antenna has six slot arrays 102A to 1102F arrayed circularly in radial directions on a substrate 101, and each of these fix slot arrays 102A to 102F is composed of slots of five elements. In these slot arrays, the simplex characteristics are that the principal beam is formed with a vertical plane of an angle of elevation of 60 degrees, and that a conical plane has a half-value angle of about 56 degrees.

This multi-sector antenna is constituted such that a six-sector antenna having six sectors dividing the 360 degrees of the horizontal plane is formed arraying the six slot arrays at an interval of 60 degrees in the horizontal plane, and by feeding the individual slot arrays selectively. This sector antenna is so sized for an operating frequency of 5 GHz, for example, as to have a diameter L7 of 273 mm (or 4.55 wavelengths) and an area of 58,535 square mm.

Another antenna proposed is a multi-sector antenna using the "waveguide element sharing patch Yagi-Uda array", as described in Patent Document 1.

This multi-sector antenna is described with reference to FIG. 12. This multi-sector is formed on the surface of a circular dielectric substrate 201 such that waveguide elements 203A to 203F of rectangular patches are arrayed radially around a regular hexagonal type waveguide element 202, and such that feeding elements 204A to 204F are arranged on the outer sides of the waveguide elements 203A to 203F. Thus, these three rows of waveguide elements intersect with each other at an angle of 60 degrees around the regular hexagonal type waveguide element 202, thereby to constitute the six-row patch Yagi-Uda array.

Here in case one feeding element is fed, the waveguide element row including the regular hexagonal type waveguide element operates as the Yagi-Uda array. At this time, the principal beam is formed in the direction of the vertical plane having the elevation angle θ of 45 degrees, and the conical plane pattern has a half-value angle of about 63 degrees. By thus feeding the feeding elements selectively, it is possible to constitute the six-sector antenna, in which the 360 degrees of the horizontal plane are divided by six. This sector antenna is sized for an operating frequency of 5 GHz, for example, to have a diameter L8 of 1.83 wavelength (110 mm) and an area of 9,503 square mm.

Non-Patent Publication 1: Papers (B) of Association of Electronic Information Communications, Vol. J85-B, No. 9, pp 1633-1643, September 2002.

Patent Document 1: JP-A-2003-142919.

DISCLOSURE OF THE INVENTION

Problems that the Invention is to Solve

However, the plane multi-sector antenna using the former "slot Yagi-Uda array" of the aforementioned plane multi-sector antennas needs slot arrays of the number of sectors thereby to have a problem that the plane sizes are enlarged, because the individual slot arrays are independently operated for every sectors. In the vertical plane, on the other hand, the principal beam has a constant elevation angle θ thereby to cause a problem that the communication quality is easily degraded depending upon the position of the communication destination.

On the other hand, the latter multi-sector antenna using the "waveguide element sharing patch Yagi-Uda array" has a problem that the plane sizes are enlarged, because it uses a plurality of patches having one side of about one half wavelength as the antenna element. In the vertical plane, moreover, the principal beam direction is constant at 45 degrees, there arises another problem that the communication quality is degraded depending upon the disposed position of the communication destination.

The invention has been conceived in view of the background thus far described and has an object to provide an antenna device and a multi-beam antenna device, which have such a small-sized plane structure as is easily mounted on a small radio device, which form a vertical polarization principal beam tilted in a horizontal direction and which can control the principal beam direction in a vertical plane.

Means for Solving the Problems

An antenna device of the invention is characterized by comprising: a first slot element and a second slot element arranged on a conductor plate in parallel and at a predetermined spacing and each having an electrical length of about one half wavelength; a reflecting plate arranged at a position in parallel with and at a predetermined distance from said conductor plate; first to fourth linear parasitic elements so arrayed in series at a predetermined spacing between said conductor plate and said reflecting plate as to intersect said first and second slot elements at right angles; a first switching element interposed between said first and second linear parasitic elements for switching a state to connect said first and second linear parasitic elements electrically and an unconnected state; and a second switching element interposed between said third and fourth linear parasitic elements for switching a state to connect said third and fourth linear parasitic elements electrically and an unconnected state.

According to this constitution, it is possible to realize a small-sized multi-beam antenna, which has a plane structure and can switch a principal beam in directions of low and high elevation angles in a vertical plane.

Moreover, an antenna device of the invention is characterized by comprising: a third slot element and a fourth slot element so arranged on said conductor plate in parallel and at a predetermined spacing as to intersect said first and second slot elements at right angles, and each having an electrical length of about one half wavelength; fifth to eighth linear parasitic elements so arrayed in the same plane as that of said first to fourth linear parasitic elements and in series at a predetermined spacing as to intersect said first and fourth slot elements at right angles; a third switching element interposed between said fifth and sixth linear parasitic elements for switching a state to connect said fifth and sixth linear parasitic elements electrically and an unconnected state; and a fourth switching element interposed between said seventh and eighth linear parasitic elements for switching a state to connect said seventh and eighth linear parasitic elements electrically and an unconnected state.

According to this constitution, it is possible to realize a small-sized four-direction sector antenna, which has a plane structure and can switch the principal beam direction in the vertical plane.

Moreover, an antenna device of the invention is characterized by comprising: four slot elements arranged in such a rhombus shape on said conductor plate that one side has a length of about one quarter to three eighths wavelength; first feeding means for feeding to the position, at which one end of the fifth slot element and one end of the sixth slot element are connected; a first slot alternative element connected with the other end of said fifth slot element and one end of a seventh slot element and having such a shape as is folded back while keeping the length of about one quarter wavelength; a second slot alternative element connected with the other end of said sixth slot element and one end of an eighth slot element and having such a shape as is folded back while keeping the length of about one quarter wavelength; a reflecting plate arranged at a position in parallel with and at a predetermined distance from said conductor plate; ninth to twelfth arrayed in parallel with a line joining the connecting portion of said fifth and sixth slot elements and the connecting portion of said seventh and eighth slot elements and at a predetermined spacing between said conductor plate and said reflecting plate; a fifth switching element interposed between said ninth and tenth linear parasitic elements for switching a state to connect said ninth and tenth linear parasitic elements electrically and an unconnected state; and a sixth switching element interposed between said eleventh and twelfth linear parasitic elements for switching a state to connect said eleventh and twelfth linear parasitic elements electrically and an unconnected state.

According to this constitution, it is possible to realize a small-sized two-direction sector antenna, which has a plane structure and can switch the principal beam direction in directions of low and high elevation angles in the vertical plane.

Moreover, an antenna device of the invention is characterized in that second feeding means is arranged at the position, at which the other end of said seventh slot element and the other end of said eighth slot element are connected.

According to this constitution, it is possible to realize a small-sized four-direction sector antenna, which has a plane structure and can switch the principal beam direction in directions of low and high elevation angles in the vertical plane.

Moreover, an antenna device of the invention is characterized: in that said slot elements and said slot alternative elements are constituted of a copper foil pattern on the surface of a dielectric substrate; and in that said linear parasitic elements are constituted of a copper foil pattern on the back of said substrate.

According to this constitution, it is possible to realize an antenna device of a high productivity, which can be easily manufactured.

Moreover, an antenna device of the invention is characterized: in that the spacing between said conductor plate and said reflecting plate is set to about one quarter wavelength or more and about one half wavelength or less; and in that the spacing between said slot elements and said linear parasitic elements is set to about one sixth wavelength or more and about one quarter wavelength or less.

According to this constitution, it is possible to switch the principal beam in the directions of low and high elevation angles in the vertical plane, and to enlarge the angular change in the vertical plane.

Moreover, an antenna device of the invention is characterized: in that said dielectric substrate has a thickness set to about one sixth or more and about one quarter or less of the effective wavelength in a dielectric element; and in that the spacing between the copper foil pattern on the back of said substrate and said reflecting plate is set to about one quarter or more and about one third or less of a free space wavelength.

According to this constitution, it is possible to switch the principal beam in the directions of low and high elevation angles in the vertical plane, and to enlarge the angular change in the vertical plane.

Moreover, a multi-beam antenna device of the invention is characterized in that a plurality of antenna devices as set forth in any of claims 1 to 7 are individually arranged isometrically on a flat face.

According to this constitution, it is possible to realize a sector antenna, which forms a principal beam in a desired direction with a plane structure.

Advantage of the Invention

According to the invention: the first and second slot elements having the electrical length of about one half wavelength are arranged in parallel at the predetermined spacing; the reflecting plate is disposed at the predetermined spacing from the arrangement face of the slot elements; and the linear parasitic elements are so formed between the arrangement face of the slot elements and the reflecting plate face as to intersect the slot elements at right angles. The linear parasitic elements are adjusted in length by switching the connections/disconnections with the switching elements by feeding the slot elements in phase difference, so that the principal beam of the vertical polarization tilted in the horizontal direction can be formed in the direction of a low elevation angle and in the direction of a high elevation angle and so that the principal beam direction can also be switched in the horizontal plane by adjusting the phase difference. Thus, it is possible to realize a multi-beam antenna device having a small size and a plane structure.

According to the invention, the four-sector antenna having a small size and a plane structure can be realized by having two sets of two slot elements arranged in parallel and by arranging the two sets of slot elements at right angles in their radial directions. Moreover, the slot elements having a length of about one third wavelength are arranged in a square shape, and the slot alternative elements are disposed at one set of crests opposed to each other. Moreover, the reflecting plate is arranged at the position in parallel and at the predetermined spacing from the arrangement face of the slot elements. By forming the linear parasitic elements between the arrangement face of the slot elements and the reflecting plate face and by switching the connections/disconnections of the linear parasitic elements with the switching elements, it is possible to realize a multi-beam antenna having a small size and a plane structure, which can form the principal beam of the vertical polarization tilted in the horizontal direction in the direction of the low elevation angle and in the direction of the high elevation angle.

BEST MODE FOR CARRYING OUT THE INVENTION

First Embodiment

Figure 1:
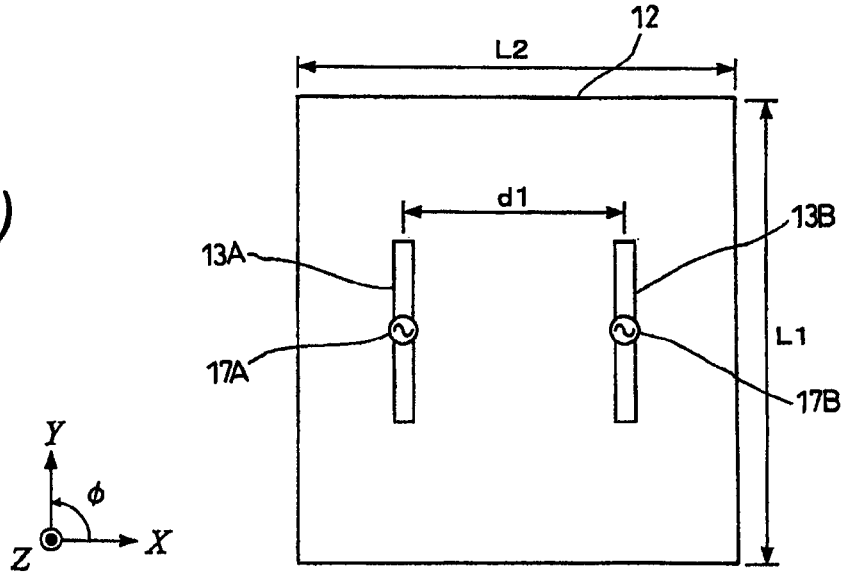
FIG. 1 shows a constitution of an antenna device according to a first embodiment of the invention: (A) a top plan view; (B) a side elevation; and (C) a top plan view taken from the back.
Figure 1:
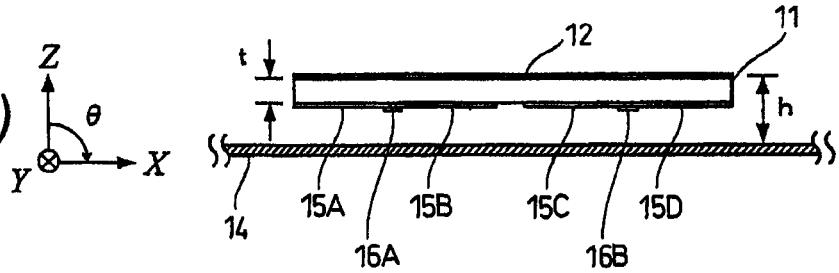
Figure 1:
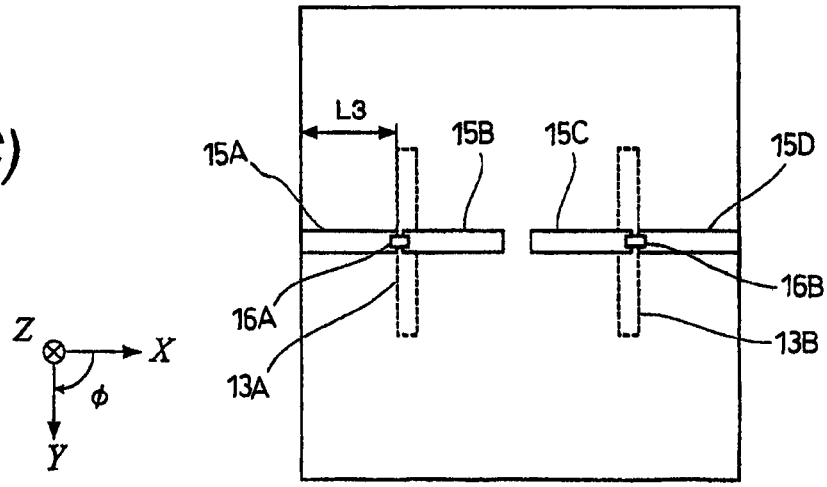

FIG. 1 shows a constitution of an antenna device according to a first embodiment of the invention. This antenna device includes a substrate 11 made of a dielectric material, a copper foil layer 12, slot elements 13A and 13B, a reflecting plate 14, parasitic elements 15A to 15D, switching elements 16A and 16B, and feeding portions 17A and 17B. Here, this embodiment is described for an antenna operating frequency of 5 GHz.

The substrate 11 has a specific dielectric constant $\in r$ of 2.6, a thickness t of 8 mm (or 0.21 wavelength (i.e., an effective wavelength in a dielectric)), and sizes L1×L2 of 44 mm×46 mm (or 0.73 wavelength×0.77 wavelength), for example.

The copper foil layer 12 is made of a copper foil adhered to the +Z side face of the substrate 11.

The slot elements 13A and 13B are formed into such cavities by cutting the copper foil layer 12 as have a length of 18.5 mm (or about 0.5 wavelength) and a width of 1 mm. The slot elements 13A and 13B are arranged in parallel at an element distance d1 of 20 mm, for example, and at the center of the substrate 11.

The reflecting plate 14 is a conductor plate, which is dislocated from the face, in which the slot elements 13A and 13B are arranged, to the −Z side by a distance h of 25 mm (or 0.42 wavelength).

The parasitic elements 15A to 15D are formed of the copper foil pattern on the −Z side face of the substrate 11, and have a length L3 of about 10 mm (or about 0.27 wavelength). The parasitic elements 15A to 15D are so arranged at the center of the substrate 11 and in parallel with one another as to intersect the slot elements 13A and 13B at right angles.

The switching elements 16A and 16B are made of PIN diodes, for example. Of these, the switching element 16A is connected with the parasitic element 15A and the parasitic element 15B, and the switching element 16B is connected with the parasitic element 15C and the parasitic element 15D. In case the reverse bias is applied to the switching elements 16A and 16B, the PIN diodes are turned OFF and opened. As a result, the parasitic element 15A and the parasitic element 15B, and the parasitic element 15C and the parasitic element 15D come into the disconnected state. In case the forward bias is applied to the switching elements 16A and 16B, moreover, the PIN diodes are turned ON and closed. As a result, the parasitic element 15A and the parasitic element 15B, and the parasitic element 15C and the parasitic element 15D are individually connected, and become equivalent to the state, in which two parasitic elements of about 20 mm (or about 0.54 wavelength) are arrayed in series.

Here are explained the operations of the case, in which the slot elements 13A and 13B are excited with a phase difference in the antenna device having the constitution thus far described. Here, it is assumed that the slot elements 13A and 13B are excited by the feeding portions 17A and 17B, respectively, so that the excitation phase of the feeding portion 17A is delayed by about 50 degrees, for example, with respect to that of the feeding portion 17B.

(I) At first, here are described the operations of the time when the reverse bias is applied to the switching elements 16A and 16B.

In the case of applying the reverse bias, the parasitic elements 15A to 15D are not electrically connected, so that their lengths are sufficiently shorter than the half wavelength of the operating frequency thereby to exert no influence upon the antenna characteristics.

Figure 2:
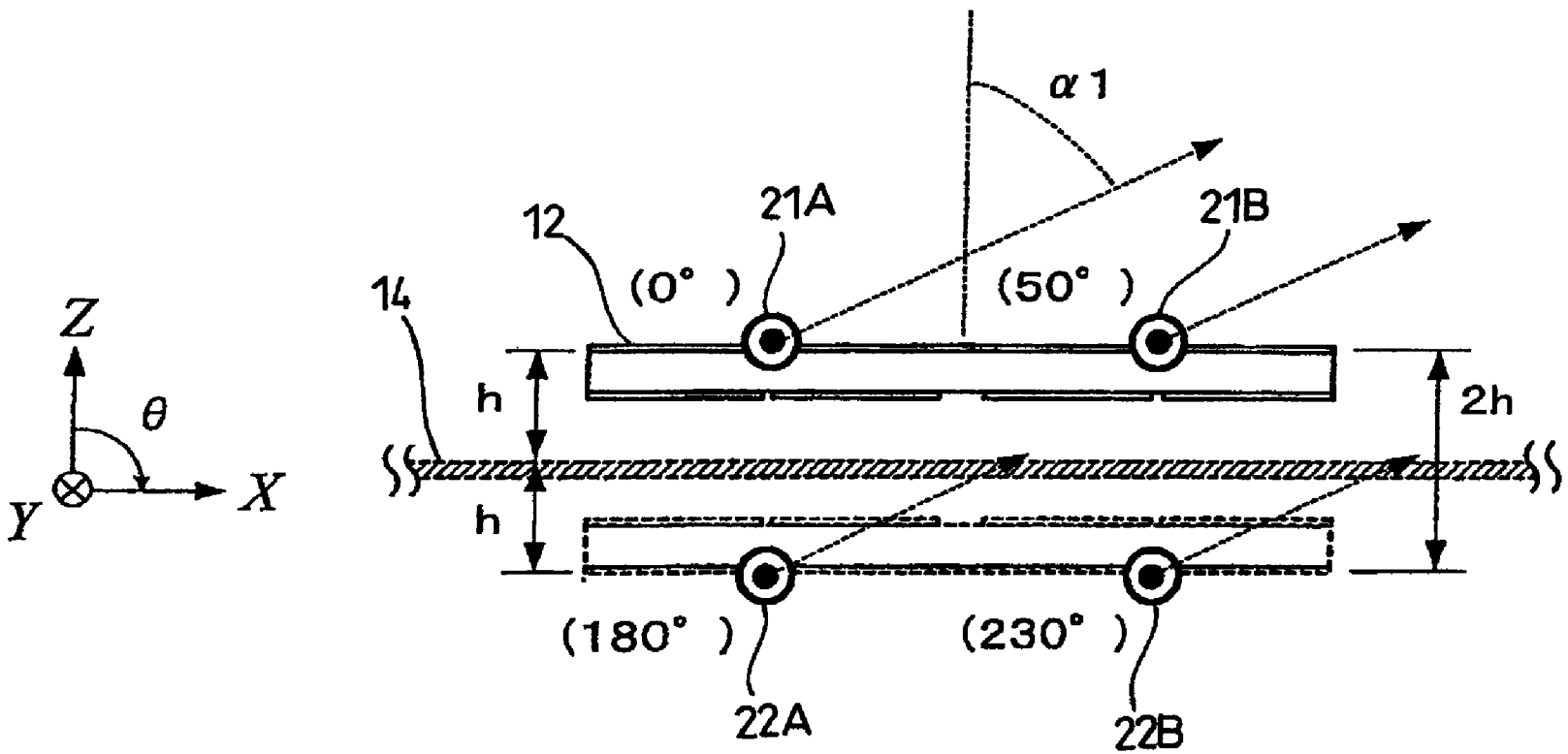
FIG. 2 is an operation-explaining diagram at the time when a reverse bias is applied to a switching element of an antenna device according the first embodiment of the invention.

FIG. 2 is an operation explaining diagram showing the state at this time, and models the effects of the reflecting plate 14 on the mapping principle while noting only the vertical (XZ) plane.

In FIG. 2, the slot elements 13A and 13B shown in FIG. 1 are modeled with point wave sources 21A and 21B. The image wave sources 22A and 22B of the point wave sources 21A and 21B are imagined at the positions symmetric with respect to the reflecting plate 14, that is, at the positions spaced by 2h (50 mm (0.84 wavelength)) to the −Z side. The excitation phases of the image wave sources 22A and 22B at this time are inverted by 180 degrees from those of the point wave sources 21A and 21B, respectively.

By synthesizing the radiations of the four wave sources described above, the principal beam is formed in the direction which is tilted by 60 degrees to the +X side in the +Z direction. At this time, the principal polarization component is the vertical polarization Eθ component.

Figure 3:
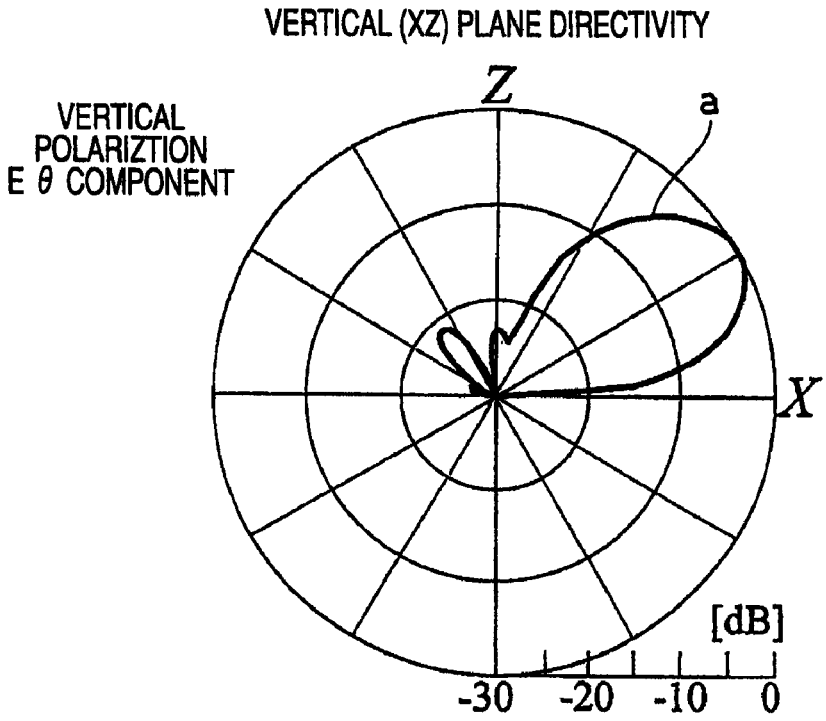
FIG. 3 presents diagrams showing the directivities of the antenna device at that time.
Figure 3:
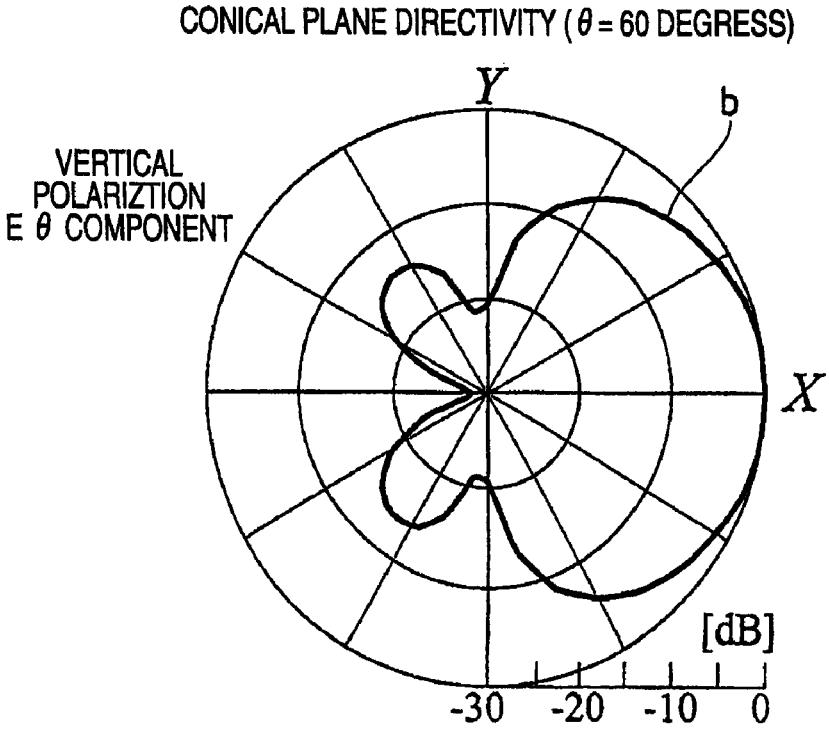

FIG. 3 presents radiation patterns indicating the directivities of the antenna device, as shown in FIG. 1, when the reverse bias is applied to the switching elements 16A and 16B. In FIG. 3, (A) indicates the directivity of the vertical (XZ) plane, and (B) indicates the directivity of the circular cone at the angle of elevation θ of 60 degrees.

In (A) of FIG. 3, a directivity a indicates that of the vertical polarization Eθ component, and it is possible to confirm that the principal beam obtained is tilted in the direction of the elevation angle θ of 60 degrees. In (B) of FIG. 3, a directivity b indicates that of the vertical polarization Eθ component like the directivity a, and it is possible to confirm that the principal beam is directed in the +X direction. At this time, the principal beam has a directivity gain of 12.3 dBi, and the circular cone pattern has a half-value angle of 87 degrees.

(II) Here is described the operations at the time when the forward bias is applied to the switching elements 16A and 16B.

In case the forward bias is applied, the parasitic element 15A and the parasitic element 15B, and the parasitic element 15C and the parasitic element 15D individually come into the connected state so that they become linear elements having about 0.54 wavelength thereby to act as reflection elements. This is identical to the state, in which the position of the reflecting plate 14 is brought artificially close to slot elements.

Figure 4:
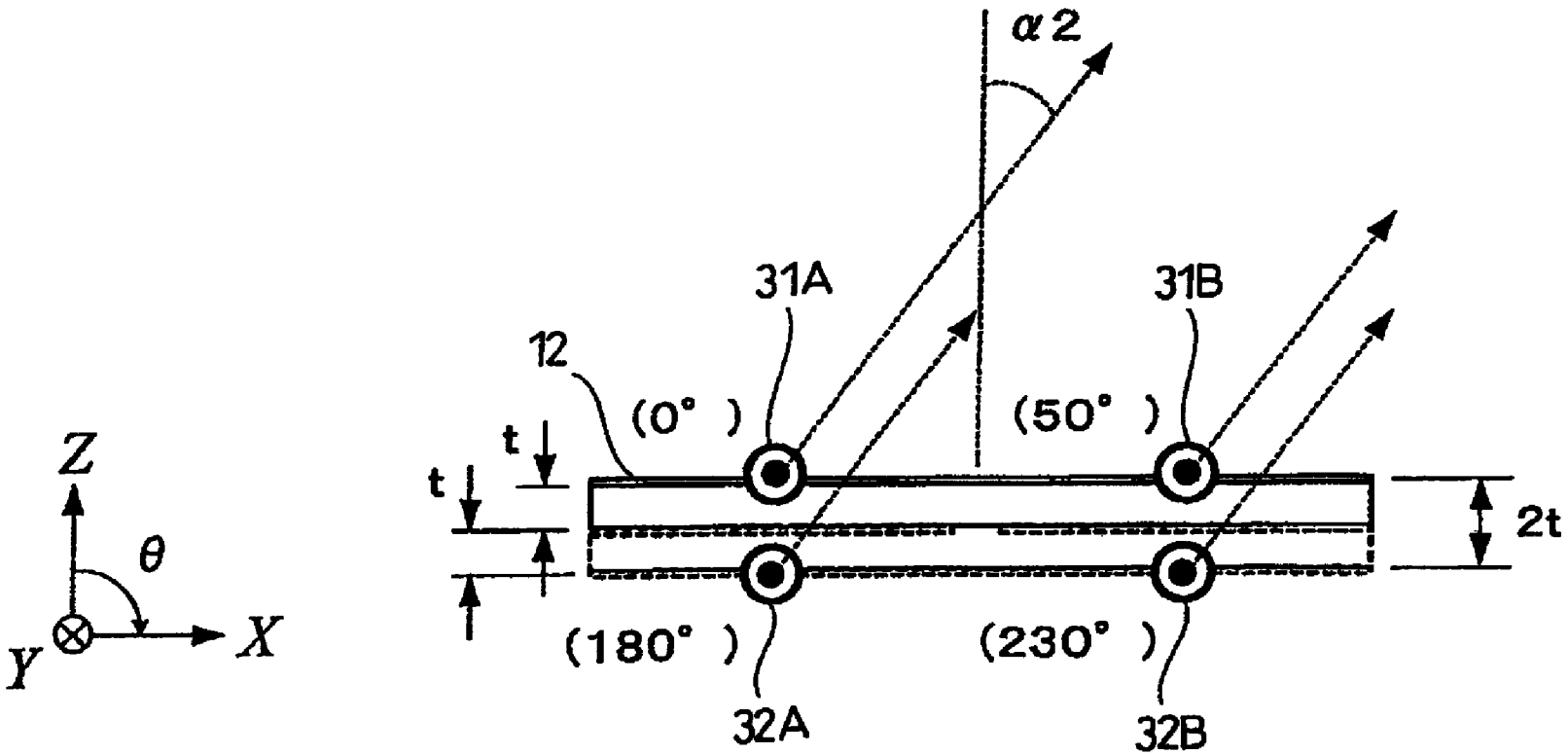
FIG. 4 is an operation-explaining diagram at the time when a forward bias is applied to a switching element of an antenna device according the first embodiment of the invention.

FIG. 4 shows a model, which is made from the state at this time on the mapping principle while noting only the vertical (XZ) plane. In FIG. 4, the slot elements 13A and 13B are modeled by point wave sources 31A and 31B. The image wave sources 32A and 32B of the point wave sources 31A and 31B are supposed at positions symmetric with respect to the reflection elements, i.e., at positions spaced by 2t (16 mm (0.27 wavelength)) to the −Z side. By synthesizing the radiations from those four wave sources, the principal beam formed is tilted in the direction of 30 degrees from the +Z direction to the +X side. At this time, the principal polarization component is the vertical polarization Eθ component.

Figure 5:
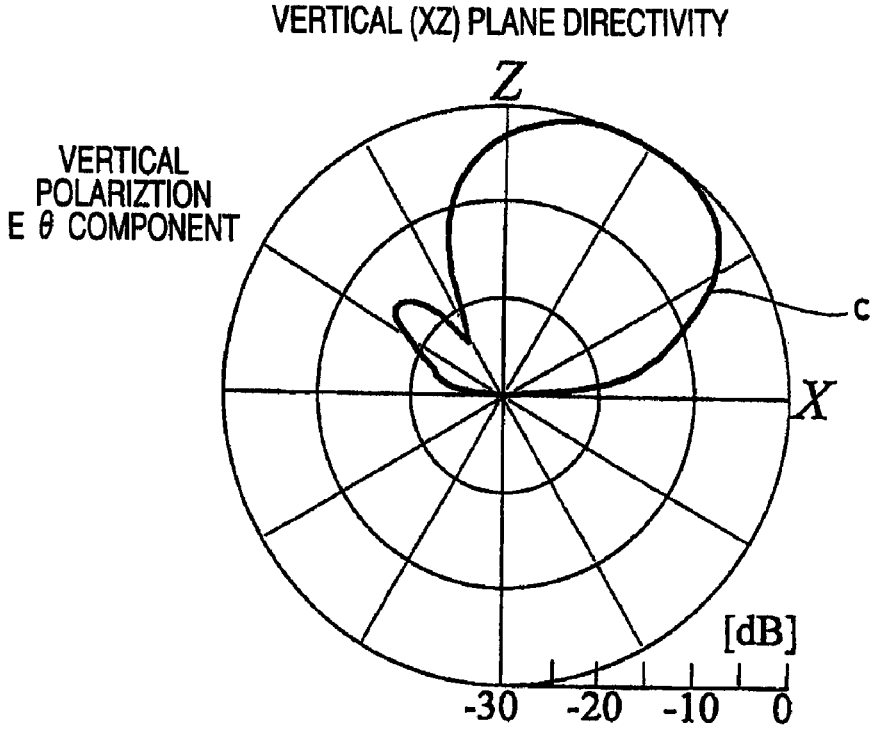
FIG. 5 presents diagrams showing the directivities of the antenna device at that time.
Figure 5:
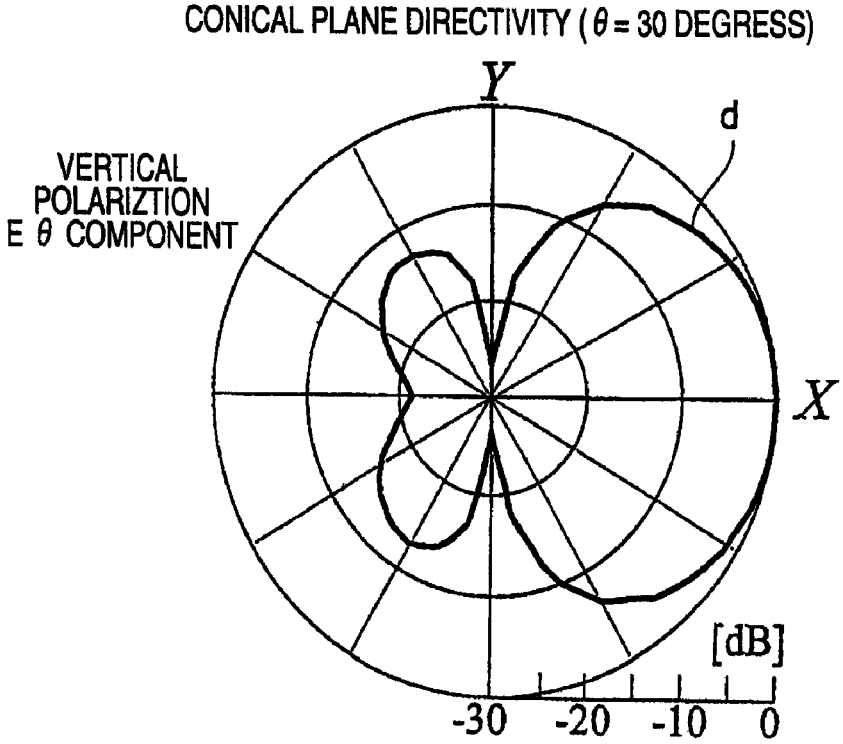

FIG. 5 presents radiation patterns indicating the directivities of the antenna device, as shown in FIG. 1, when the forward bias is applied to the switching elements 16A and 16B. In FIG. 5, (A) indicates the directivity of the vertical (XZ) plane, and (B) indicates the directivity of the circular cone at the angle of elevation θ of 30 degrees.

In (A) of FIG. 5, a directivity c indicates that of the vertical polarization Eθ component, and it is possible to confirm that the principal beam obtained is tilted in the direction of the elevation angle θ of 30 degrees. In (B) of FIG. 5, a directivity d indicates that of the vertical polarization Eθ component like the directivity c, and it is possible to confirm that the principal beam is directed in the +X direction. At this time, the principal beam has a directivity gain of 9.4 dBi, and the circular cone pattern has a half-value angle of 86 degrees.

By thus exciting the slot element 13A with a delay of about 50 degrees from the slot element 13B, the principal beam obtained is tilted to the +X side. By switching the lengths of the parasitic elements 15A to 15D with the switching elements, the principal beam direction can be switched in the vertical (XZ) plane. If the slot element 13A is excited about 50 degrees earlier than the slot element 13B, the principal beam obtained is tilted to the −X side, so that the principal beams of four directions can be formed by making the antenna constitution, as shown in FIG. 1.

Moreover, the gain is high, in case the principal beam is formed in the direction of a low elevation angle θ of 60 degrees, but low, in case the principal beam is formed in the direction of a high elevation angle θ of 30 degrees. Therefore, the antenna device is suitable as the antenna for a stationary station to be disposed in the ceiling or a card terminal to be inserted into a note personal computer. The stationary station in the ceiling has a high elevation angle in the floor direction so that it does not need a high gain, but communicates at a low elevation angle with a distant terminal so that it needs the high gain.

As has been described hereinbefore, according to this embodiment, the two slot elements are arranged in parallel at the predetermined spacing on the surface of the substrate, and the linear parasitic elements are so formed on the back of the substrate as to intersect the slot elements at right angles. Moreover, the reflecting plate is disposed at the predetermined spacing from the slot elements thereby to feed the slot elements in the phase difference, and the linear parasitic elements are adjusted in length by switching the connections/disconnections with the switching elements. As a result, the principal beam can be switched in the directions of the low and high elevation angles in the vertical plane with the small and plane structure. By adjusting the phase difference of the slot elements, moreover, it is possible to realize the multi-beam antenna, which can switch the principal beam direction in a horizontal plane, too.

Here, this embodiment has been described on the constitution, in which the distance h between the slot elements and the reflecting plate is 25 mm (or 0.42 wavelength). By changing the distance h, however, a vertical plane tilting angle α can be changed. In case the parasitic elements are not operated as reflecting elements, the vertical plane tilting angle α has tendencies to become smaller, as the distance h is made shorter, and to become larger as the distance h is made longer. As the distance h is enlarged, however, a back lobe is caused in the direction opposed to the principal beam in the −X direction. It is, therefore, desired that the distance h is selected within the range of one quarter wavelength to one half wavelength properly for the application. In this embodiment, the distance h is set to 0.42 wavelength (or the electric distance is set to about 0.5 wavelength, considering the thickness of the substrate), which makes the F/B ratio satisfactory to maximize the vertical plane tilting angle. Moreover, this value is set to enlarge the angular difference at the vertical plane beam switching time, but to direct the principal beam as much as possible in the low elevation angle direction, in case the parasitic elements are not operated as the reflecting elements.

Moreover, this embodiment has been described on the constitution, in which the substrate has a thickness t of 8 mm (or 0.21 wavelength). In case the parasitic elements are operated as the reflecting elements by changing that thickness t, the vertical plane tilting angle has tendencies to become smaller as the thickness t is made smaller and to become larger as the thickness t is made larger. It is, therefore, desired to select the thickness t properly within a range of one sixth wavelength to one quarter wavelength according to the application. In this embodiment, the thickness t is set to 0.21 wavelength, which optimizes the vertical plane tilting angle in the high elevation direction and the F/B ratio and to enlarge the angular difference at the vertical plane beam switching time.

Moreover, this embodiment has been described on the constitution, in which the substrate has the thickness of 8 mm. However, similar effects can be attained even if the constitution is modified such that the resin is sandwiched between the substrates formed of two sheets of a thin dielectric material.

Moreover, this embodiment has been described on the constitution, in which the slot elements are directly fed, but similar effects can be obtained even if the constitution is modified such that the slot elements are fed by using a microstrip line. At this time, the phase difference feeding method can be realized by the T-branch circuit, the π-branch circuit or the like.

In this embodiment, moreover, the slot elements are formed by the copper foil pattern on the substrate. However, similar effects can be attained even if the slot elements are formed by forming cavities in a conductor plate, for example. If the wavelength shortening by the substrate is then considered, it is necessary to enlarge the distance between the slot elements and the reflecting plate.

In this embodiment, moreover, the PIN diodes are used as the switching elements, but similar effects can be attained even if the constitution is made by using another device such as an FET.

Second Embodiment

Next, an antenna device according to a second embodiment of the invention is described in detail with reference to the accompanying drawings. In this embodiment, however, the same portions as those of the first embodiment shown in FIG. 1 are omitted in their detail description by designating them by the common reference numerals. Here, the description is also made in this embodiment by assuming that the operating frequency of the antenna is 5 GHz.

Figure 6:
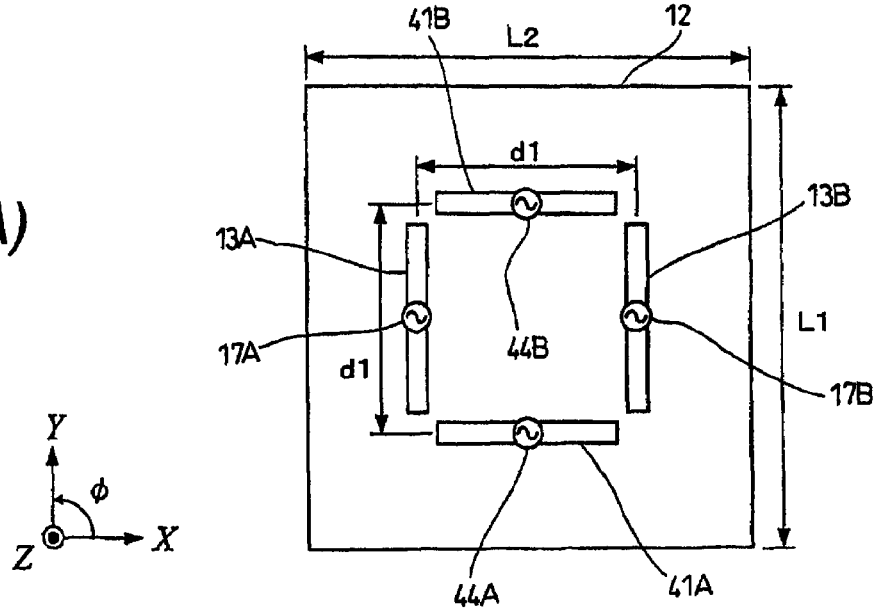
FIG. 6 shows a constitution of an antenna device according to a second embodiment of the invention: (A) a top plan view; (B) a side elevation; and (C) a top plan view taken from the back.
Figure 6:
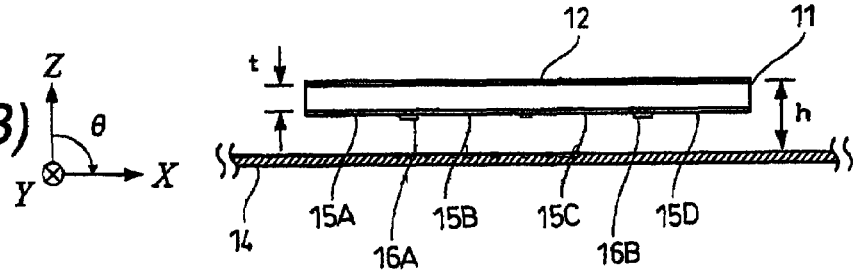
Figure 6:
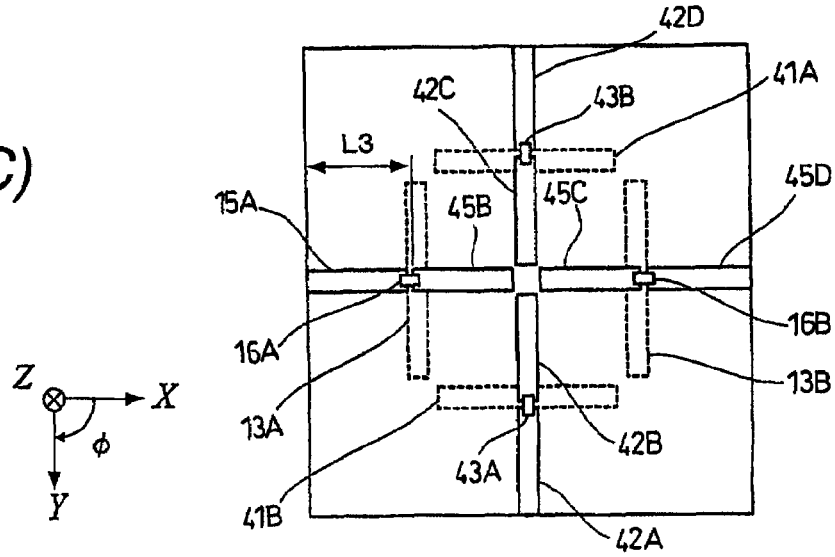

FIG. 6 shows a constitution of the antenna device according to the second embodiment of the invention. This antenna device is equipped with not only the slot elements 13A and 13B but also slot elements 41A and 41B, and is constituted by arraying two sets of antenna devices of the first embodiment at right angles.

The slot elements 41A and 41B are formed into such cavities by cutting the copper foil layer 12 as have a length of 18.5 mm and a width of 1 mm. The slot elements 41A and 41B are arranged to intersect the slot elements 13A and 13B at right angles with the same element distance d1 of 20 mm as that of the slot elements 13A and 13B, for example, thereby to form a square shape together with the slot elements 13A and 13B.

Parasitic elements 42A to 42D are formed of the copper foil pattern on the −Z side face of the substrate 11, and have the same length of about 10 mm (or about 0.27 wavelength) as that L3 of the parasitic elements 15A to 15D. The parasitic elements 42A to 42D are so arrayed at the center of the substrate 11 in series as to intersect the slot elements 41A and 41B and the parasitic elements 15A to 15D at right angles.

Next, the operations of the antenna device according to the embodiment thus far described are explained in the following.

In FIG. 6, the slot elements 13A and 13B and the slot elements 41A and 41B are individually selectively excited. Specifically, in case the slot elements 13A and 13B are excited in phase difference, the principal beam is changed in the ±X directions. In case the slot elements 41A and 41B are excited in phase difference, the principal beam is changed in the ±Y directions. At this time, the non-excited slot elements are short-circuited at the element center, for example.

As described above, the phase difference excitations of the slot elements 13A and 13B and the phase difference excitations of the slot elements 41A and 41B are similar in operations except that the principal beam directions are different. Here are described only the operations of the case, in which the slot elements 41A and 41B are excited in the phase difference.

In this case where the excitation phase of a feeding portion 44A is delayed by about 50 degrees from that of a feeding portion 44B and where the reverse bias is applied to switching elements 43A and 43B, as has been described in connection with the first embodiment, the parasitic elements 42C to 42D are not electrically connected. As a result, no influence is exerted on the antenna characteristics so that the principal beam formed is tilted by 60 degrees to the +Y side in the +Z direction. The principal polarization component at this time is the vertical polarization Eθ component, so that the slot elements 13A and 13B and the parasitic elements 15A to 15D, as formed perpendicular to the principal polarization, exert no influence upon the antenna characteristics.

In case the forward bias is applied to the switching elements 43A and 43B, moreover, the parasitic element 42A and the parasitic element 42B, and the parasitic element 42C and the parasitic element 42D individually come into the connected state. Therefore, they become linear elements having about 0.54 wavelength thereby to act as reflection elements. As a result, the principal beam formed is tilted by 30 degrees to the +Y side in the +Z direction.

Here, in case the excitation phase of the feeding portion 44A is advanced by about 50 degrees with respect to the excitation phase of the feeding portion 44A, the principal beam is formed in the direction tilted to the −Y side in the +Z direction.

Figure 7:
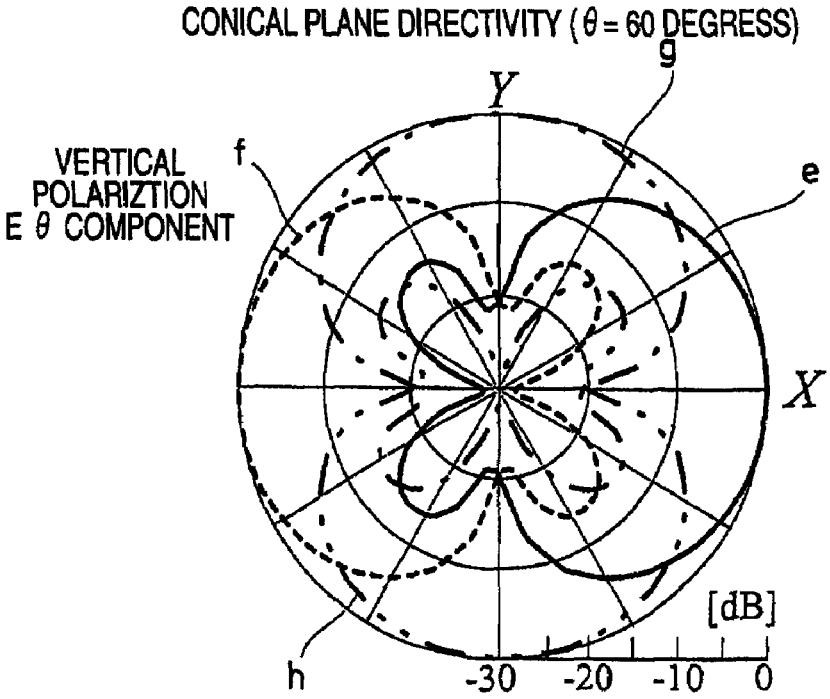
FIG. 7 presents diagrams at the time when a forward bias is applied to any of switching elements of an antenna device according the second embodiment of the invention.
Figure 7:
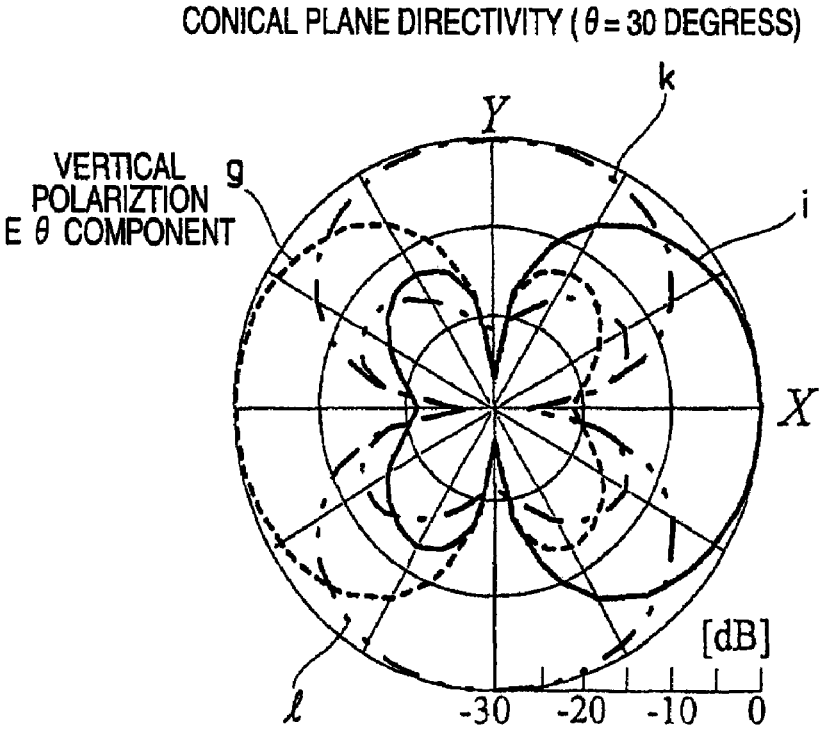

FIG. 7 presents diagrams showing the directivities of the antenna device shown in FIG. 6.

Here, FIG. 7(A) shows the directivity of the case, in which the reverse bias is applied to the switching elements 16A and 16B or the switching elements 43A and 43B so that the principal beam is formed in the direction of an elevation angle θ as low as 60 degrees. In (A) of FIG. 7, a directivity e indicates that of a conical plane of the case, in which the excitation phase of the slot element 13A is delayed by about 50 degrees with respect to the excitation phase of the slot element 13A, and a directivity f indicates that of a conical plane of the case, in which the excitation phase of the slot element 13A is advanced by about 50 degrees with respect to the excitation phase of the slot element 13B.

On the other hand, a directivity g indicates that of a conical plane of the case, in which the excitation phase of the slot element 41A is delayed by about 50 degrees with respect to the excitation phase of the slot element 41A, and a directivity h indicates that of a conical plane of the case, in which the excitation phase of the slot element 41A is advanced by about 50 degrees with respect to the excitation phase of the slot element 41B. For all these directivities e to h, the directive gain is 12.3 dBi, and the half-value angle of the conical plane pattern is 87 degrees, so that a four-sector antenna formed can cover all the azimuths in the horizontal plane at the elevation angle θ of 60 degrees.

On the other hand, FIG. 7(B) shows the directivity of the case, in which the forward bias is applied to the switching elements 16A and 16B or the switching elements 43A and 43B so that the principal beam is formed in the direction of an elevation angle θ as low as 30 degrees. In (C) of FIG. 7, a directivity i indicates that of a conical plane of the case, in which the excitation phase of the slot element 13A is delayed by about 50 degrees with respect to the excitation phase of the slot element 13A, and a directivity j indicates that of a conical plane of the case, in which the excitation phase of the slot element 13A is advanced by about 50 degrees with respect to the excitation phase of the slot element 13B.

On the other hand, a directivity k indicates that of a conical plane of the case, in which the excitation phase of the slot element 41A is delayed by about 50 degrees with respect to the excitation phase of the slot element 41A, and a directivity I indicates that of a conical plane of the case, in which the excitation phase of the slot element 41A is advanced by about 50 degrees with respect to the excitation phase of the slot element 41B. For all these directivities i to 1, the directive gain is 9.4 dBi, and the half-value angle of the conical plane pattern is 86 degrees, so that a four-sector antenna formed can cover all the azimuths in the horizontal plane at the elevation angle θ of 30 degrees.

As has been described hereinbefore, according to this embodiment, there is formed the sector antenna, which can cover the whole azimuth of the horizontal plane in the low elevation angle direction and in the high elevation angle direction. According to this embodiment, therefore, the fourth slot elements are arranged in a square shape on the surface of the substrate, and the linear parasitic elements are so formed on the back of the substrate as to intersect the slot elements at right angles. The two sets of opposed switching elements are oscillated selectively with the phase difference, and the linear parasitic elements are adjusted in length by switching the connections/disconnections with the switching elements. It is possible to realize the multi-sector antenna of four directions, which has a small and plane structure and which can change the principal beam directions in the vertical plane.

Third Embodiment

Next, an antenna device according to a third embodiment of the invention is described in detail with reference to the accompanying drawings. In this embodiment, however, the same portions as those of the first embodiment shown in FIG. 1 are omitted in their detail description by designating them by the common reference numerals. Here, the description is also made in this embodiment by assuming that the operating frequency of the antenna is 5 GHz.

Figure 8:
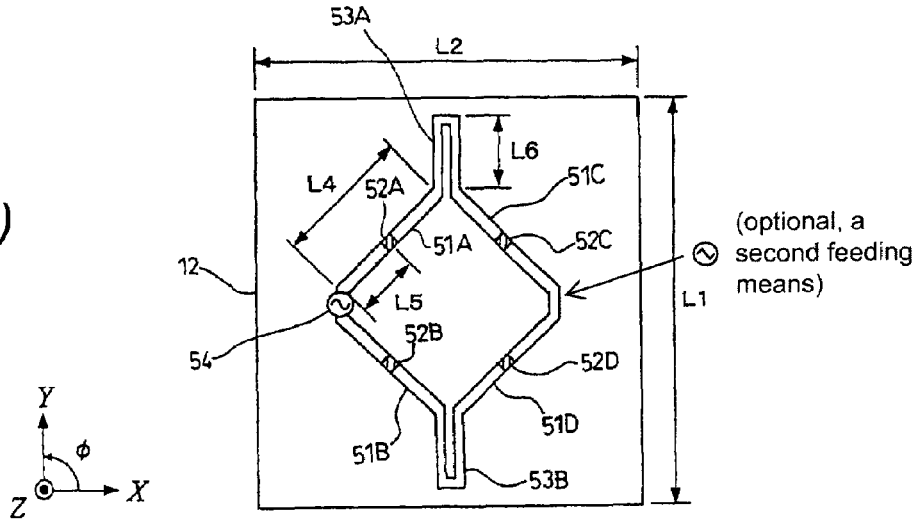
FIG. 8 shows a constitution of an antenna device according to a third embodiment of the invention: (A) a top plan view; (B) a side elevation; and (C) a top plan view taken from the back.
Figure 8:
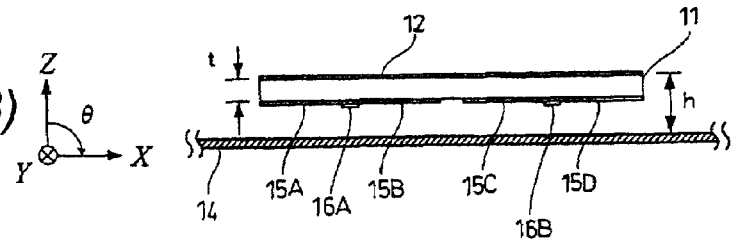
Figure 8:
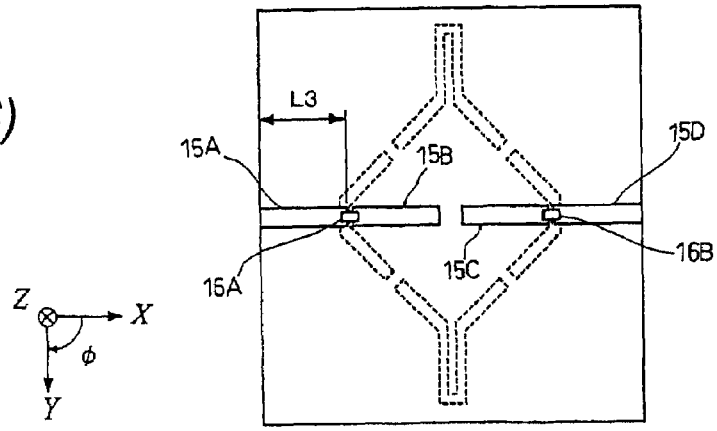

FIG. 8 shows a constitution of the antenna device according to the third embodiment of the invention. Slot elements 51A to 51D, connecting conductors 52A to 52D, parasitic elements 15A to 15D, slot alternative elements 53A and 53B and a feeding portion 54 are included in the copper foil layer 12 of the substrate 11.

The slot elements 51A to 51B are formed into such cavities by cutting the copper foil layer 12 as are arranged in a square shape to have an element length L4 of 16.3 mm (or about one third wavelength) and an element width of 1 mm, for example. Here, the parasitic elements 15A to 15D are arranged on lines joining the connecting portion of the switching elements 51A and 51B and the connecting portion of the switching elements 51C and 51D.

The connecting conductors 52A to 52D are formed of a copper foil pattern, for example, on the plane common to the slot elements 51A to 51D, and connect the copper foil layers on the inner and outer sides of the slot elements 51A to 51D at the positions of a length L5 of about 5 mm. By thus connecting the copper foil layers on the inner and outer sides of the slot elements 51A to 51D through the connecting conductors 52A to 52D, the impedances of the slot elements 51A to 51D can be stabilized.

The slot alternative elements 53A and 53B are such cavities formed like the slot elements 51A to 51D by cutting the copper foil layer 12 as have a whole length of 13 mm (or about one quarter length) and as are folded back at a length L6 of 6.5 mm (or about one eighth wavelength). The element width is 1 mm. The slot alternative element 53A is connected between the slot element 51A and the slot element 51C, and the slot alternative element 53B is connected between the slot element 51B and the slot element 51D. Here, the slot element 51A and the slot element 51B, and the slot element 51C and the slot element 51D are individually connected. Here, the slot elements are excited by the feeding portion 54 interposed between the slot element 51A and slot element 51B.

According to this embodiment, therefore, the electric field takes the peak point at the connecting portion between the slot elements 51A and 51B and the slot elements 51C and 51D, so that the phase difference is established between the individual peak points by the slot alternative elements 53A and 53B. If the radiations from those electric field peak points, therefore, the constitution can be deemed such that the two slot antennas of the X-axis polarization are arrayed in parallel. In this constitution, the principal beam formed is tilted in the ±X direction from the +Z direction, as has been described in connection with the first embodiment.

Figure 9:
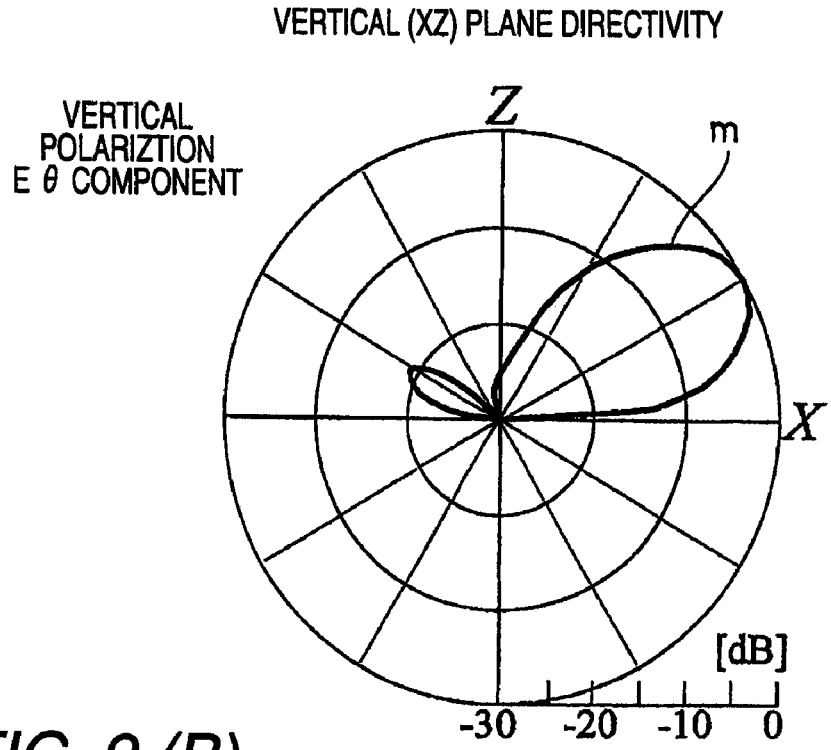
FIG. 9 presents diagrams showing the directivities at the time when a reverse bias is applied to a switching element of the antenna device.
Figure 9:
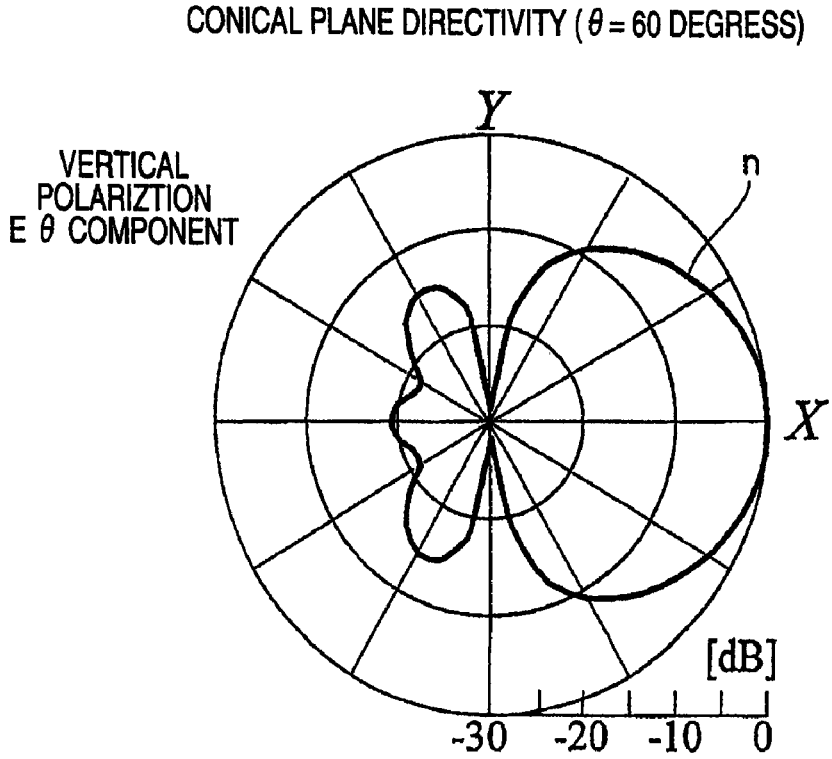

(I) FIG. 9 are diagrams showing radiation patterns indicating the directivities of the antenna device, as shown in FIG. 8, when the reverse bias is applied to the switching elements 16A and 16B. In FIG. 9, (A) indicates the directivity of the vertical (XZ) plane, and (B) indicates the directivity of the circular cone at the angle of elevation θ of 60 degrees.

In (A) of FIG. 9, a directivity m indicates that of the vertical polarization Eθ component, and it is possible to confirm that the principal beam obtained is tilted in the direction of the elevation angle θ of 60 degrees. In (B) of FIG. 9, a directivity n indicates that of the vertical polarization Eθ component like the directivity m, and it is possible to confirm that the principal beam is directed in the +X direction. At this time, the principal beam has a directivity gain of 13.2 dBi, and the circular cone pattern has a half-value angle of 62 degrees.

Figure 10:
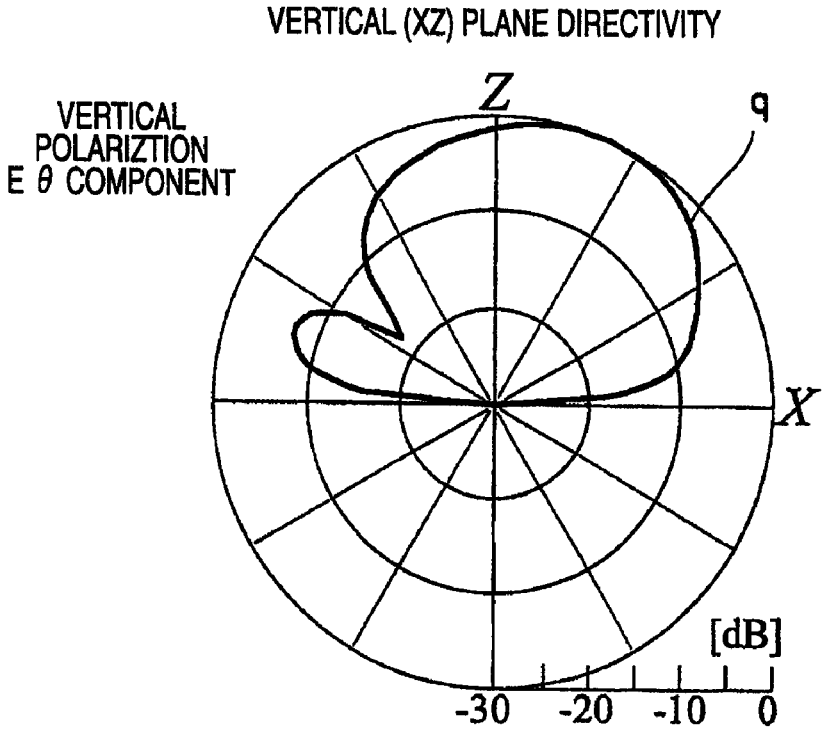
FIG. 10 presents diagrams showing the directivities at the time when a forward bias is applied to the switching element of the antenna device.
Figure 10:
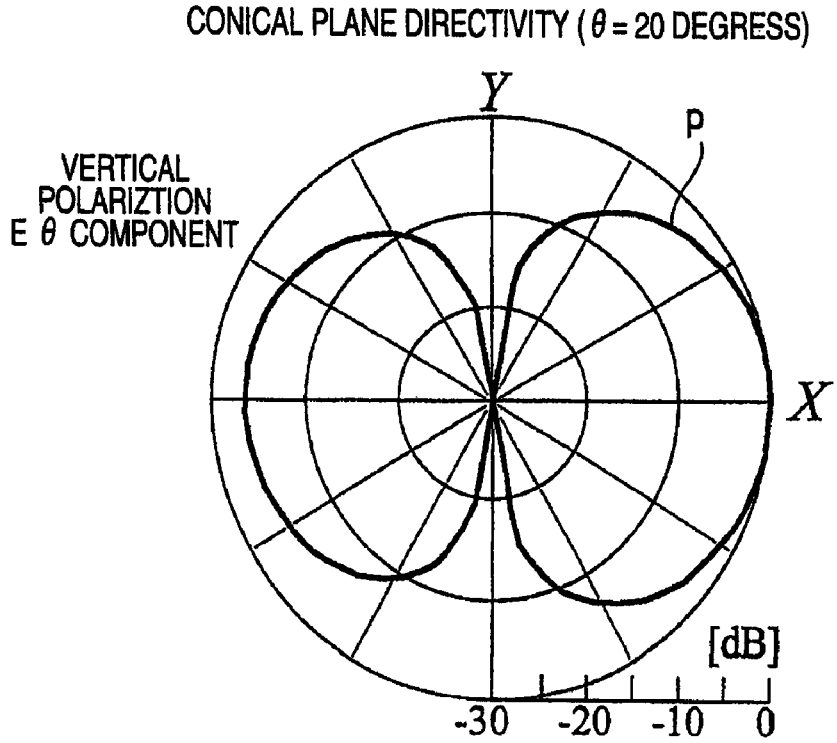
Figure 11:
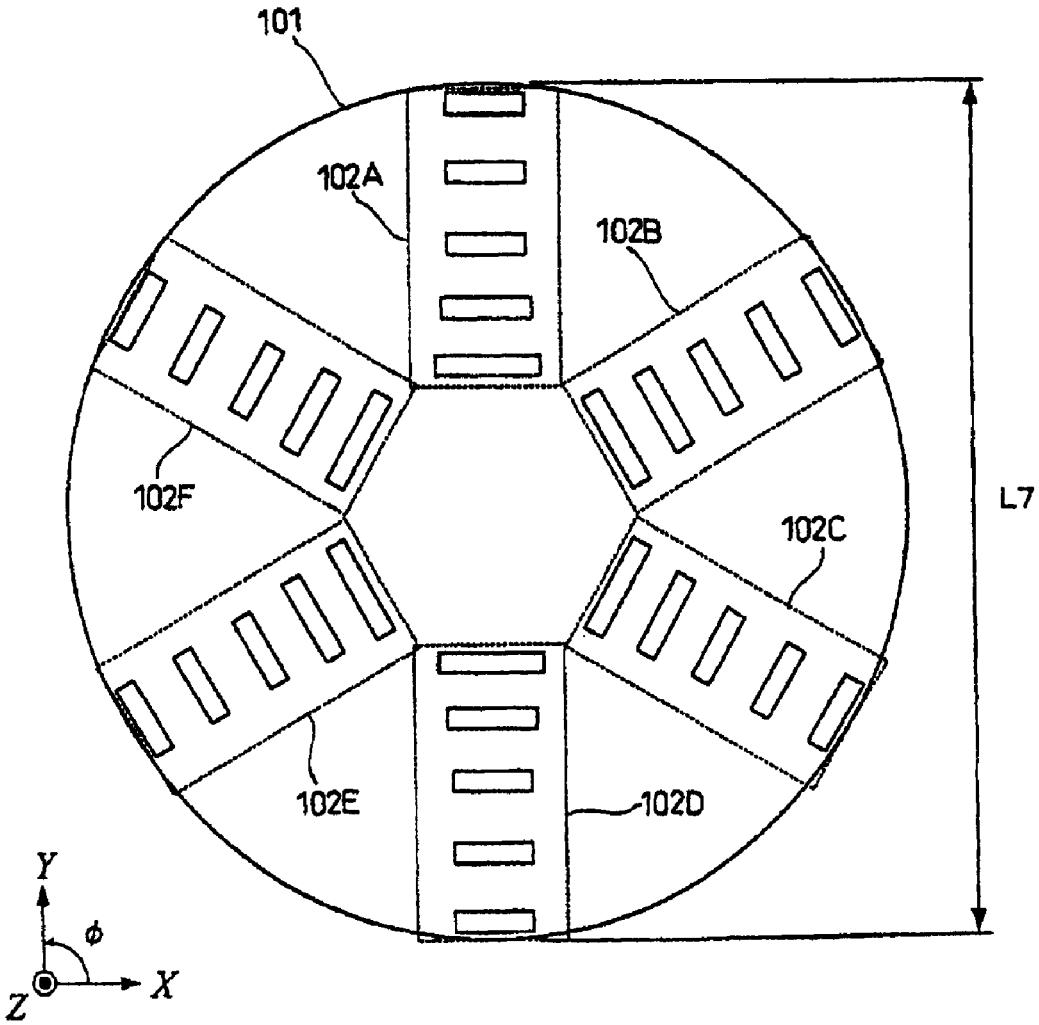
FIG. 11 PRIOR ART
FIG. 11 is a top plan view showing the constitution of a multi-sector antenna of the prior art.
Figure 12:
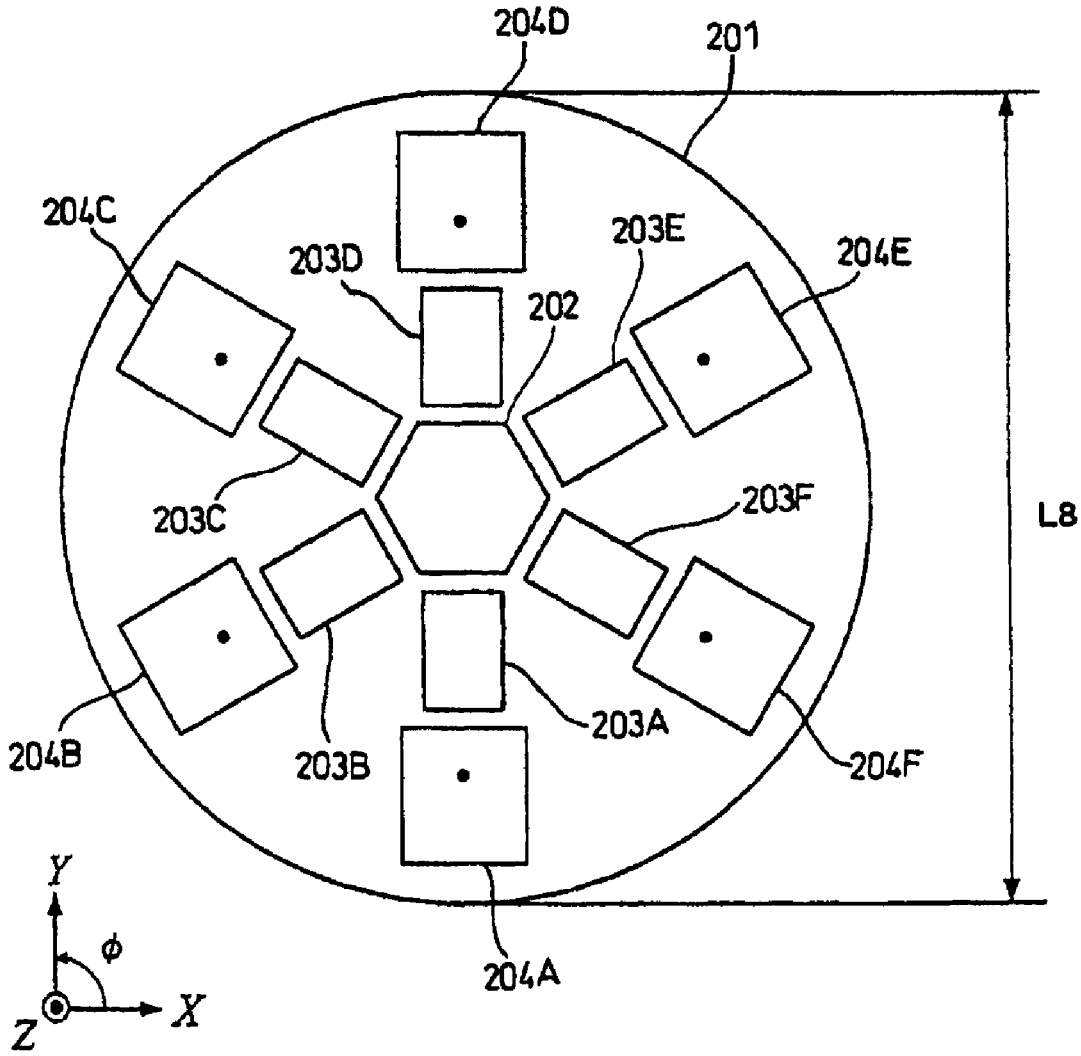
FIG. 12 PRIOR ART
FIG. 12 is a top plan view showing the constitution of another multi-sector antenna of the prior art.

(II) Next, FIG. 10 are diagrams showing radiation patterns indicating the directivities of the antenna device, as shown in FIG. 8, when the forward bias is applied to the switching elements 16A and 16B. In FIG. 10, (A) indicates the directivity of the vertical (XZ) plane, and (B) indicates the directivity of the circular cone at the angle of elevation θ of 20 degrees.

In (A) of FIG. 10, a directivity o indicates that of the vertical polarization Eθ component, and it is possible to confirm that the principal beam obtained is tilted in the direction of the elevation angle θ of 20 degrees. In (B) of FIG. 10, a directivity p indicates that of the vertical polarization Eθ component like the directivity o, and it is possible to confirm that the principal beam is directed in the +X direction. At this time, the principal beam has a directivity gain of 8.9 dBi, and the circular cone pattern has a half-value angle of 84 degrees.

With the constitution of this embodiment, as shown in FIG. 8, the principal beam obtained is tilted to the +X side. By switching the lengths of the parasitic elements 15A to 15D with the switching elements, the principal beam direction can be switched in the high elevation angle direction and in the low elevation angle direction in the vertical (XZ) plane. In the constitution shown in FIG. 8, moreover, the feeding portion 54 is interposed only between the slot elements 51A and 51B. However, the principal beam direction can be switched in the ±X direction by interposing the feeding portion between the slot elements 51C and 51D, too, for selective excitations. At this time, the feeding portions to be not excited have to be opened. Moreover, a sector antenna capable of covering the whole azimuth can be constituted by turning and arraying the constitutions of this embodiment, as shown in FIG. 8, at every equal angles on a plurality of planes.

As has been described hereinbefore, according to the antenna device of this embodiment, the slot elements 51A to 51D formed in the square shape are disposed on the surface of the substrate 11, and the slot alternative elements 53A and 53B are disposed at the crests of one opposed pair of the square. The linear parasitic elements 15A to 15D are formed on the back of the substrate, and the reflecting plate 14 is disposed at a predetermined distance from the faces of the slot elements 51A to 51D. The linear parasitic elements 51A to 51D are adjusted in length by switching the connections/disconnections with the switching elements 16A and 16B. It is, therefore, possible to realize the multi-beam antenna device, in which the principal beam can be switched in the directions of the low and high elevation angles in the vertical plane with the small and plane structure, that is, in which beams can be transmitted/received by one antenna. In this embodiment, the slot elements are arrayed in the square shape, but their array should not be limited to the square shape but may also be a circular shape or a rhombus shape.

Here, the invention should not be limited in the least to the embodiments thus far described, but can be practiced in various modes without departing from the gist and scope thereof. In the invention, for example, the inner side copper foil layer and the outer side copper foil layer of the slot elements are connected in a common plan through the connecting conductors. However, similar effects can be obtained by connecting the copper foil layers on the back of the substrate by way of through holes.

Although the invention has been described in detail and in connection with the specific embodiments, it is apparent to those skilled in the art that various modifications or corrections could be added without departing from the gist and scope of the invention.

The present application is based on Japanese Patent Application JP 2004-266604 filed in the Japanese Patent Office on Sep. 14, 2004, the entire contents of which being incorporated herein by reference.

INDUSTRIAL APPLICABILITY

The present invention has an effect to realize a small-sized multi-beam antenna of a planar constitution, in which a principal beam having a vertical polarization tilted in a horizontal direction is formed in directions of low and high elevation angles, which can switch the principal beam direction in the horizontal plane, and which can be suitably mounted on a small radio device, and can be applied to the small radio device such as a stationary radio device or a terminal radio device.

The invention claimed is:

1. An antenna device, comprising:

a first slot element and a second slot element arranged on a conductor plate in parallel and at a predetermined spacing and each having an electrical length of about one half wavelength;

a reflecting plate arranged at a position in parallel with and at a predetermined distance from said conductor plate;

first to fourth linear parasitic elements so arrayed in series at a predetermined spacing between said conductor plate and said reflecting plate as to intersect said first and second slot elements at right angles;

a first switching element interposed between said first and second linear parasitic elements for switching a state to connect said first and second linear parasitic elements electrically and an unconnected state; and a second switching element interposed between said third and fourth linear parasitic elements for switching a state to connect said third and fourth linear parasitic elements electrically and an unconnected state.

2. The antenna device as set forth in claim 1, comprising:

a third slot element and a fourth slot element so arranged on said conductor plate in parallel and at a predetermined spacing as to intersect said first and second slot elements at right angles, and each having an electrical length of about one half wavelength;

fifth to eighth linear parasitic elements so arrayed in the same plane as that of said first to fourth linear parasitic elements and in series at a predetermined spacing as to intersect said third and fourth slot elements at right angles;

a third switching element interposed between said fifth and sixth linear parasitic elements for switching a state to connect said fifth and sixth linear parasitic elements electrically and an unconnected state; and a fourth switching element interposed between said seventh and eighth linear parasitic elements for switching a state to connect said seventh and eighth linear parasitic elements electrically and an unconnected state.

3. The antenna device as set forth in claim 1, wherein:

said slot elements are constituted of a copper foil pattern on the surface of a dielectric substrate; and said linear parasitic elements are constituted of a copper foil pattern on the back of said substrate.

4. The antenna device as set forth in claim 3, wherein:

said dielectric substrate has a thickness set to about one sixth or more and about one quarter or less of the effective wavelength in a dielectric element; and the spacing between the copper foil pattern on the back of said substrate and said reflecting plate is set to about one quarter or more and about one third or less of a free space wavelength.

5. The antenna device as set forth in claim 1, wherein:

the spacing between said conductor plate and said reflecting plate is set to about one quarter wavelength or more and about one half wavelength or less; and the spacing between said slot elements and said linear parasitic elements is set to about one sixth wavelength or more and about one quarter wavelength or less.

6. An antenna device, comprising:

first to fourth slot elements arranged in such a rhombus shape on a conductor plate that one side has a length of about one quarter to three eighths wavelength;

first feeding means for feeding to the position, at which one end of said first slot element and one end of said second slot element are connected;

a first slot alternative element connected with the other end of said first slot element and one end of said third slot element and having such a shape as is folded back while keeping the length of about one quarter wavelength;

a second slot alternative element connected with the other end of said second slot element and one end of said fourth slot element and having such a shape as is folded back while keeping the length of about one quarter wavelength;

a reflecting plate arranged at a position in parallel with and at a predetermined distance from said conductor layer;

first to fourth parasitic elements so arrayed in parallel with a line joining the connecting portion of said first and second slot elements and the connecting portion of said third and fourth slot elements and at a predetermined spacing between said conductor plate and said reflecting plate;

a first switching element interposed between said first and second linear parasitic elements for switching a state to connect said first and second linear parasitic elements electrically and an unconnected state; and a second switching element interposed between said third and fourth linear parasitic elements for switching a state to connect said third and fourth linear parasitic elements electrically and an unconnected state.

7. The antenna device as set forth in claim 6, wherein a second feeding means is arranged at the position, at which the other end of said third slot element and the other end of said fourth slot element are connected.

8. The antenna device as set forth in claim 6, wherein:

said slot elements and said slot alternative elements are constituted of a copper foil pattern on the surface of a dielectric substrate; and said linear parasitic elements are constituted of a copper foil pattern on the back of said substrate.

9. The antenna device as set forth in claim 6, wherein:

the spacing between said conductor plate and said reflecting plate is set to about one quarter wavelength or more and about one half wavelength or less; and the spacing between said slot elements and said linear parasitic elements is set to about one sixth wavelength or more and about one quarter wavelength or less.

10. The multi-beam antenna device, wherein:

a plurality of antenna devices as set forth in claims 1 or 6 are individually arranged isometrically on a flat face.

* * * * *